US006284123B1

(12) United States Patent
Cimermancic et al.

(10) Patent No.: US 6,284,123 B1
(45) Date of Patent: Sep. 4, 2001

(54) ELECTROPLATING FORMULATION AND PROCESS FOR PLATING IRON ONTO ALUMINUM/ALUMINUM ALLOYS

(75) Inventors: John A. Cimermancic, Hubertus; Jerold J. Dallman, Sussex, both of WI (US)

(73) Assignee: Briggs & Stratton Corporation, Milwaukee, WI (US)

( * ) Notice: Subject to any disclaimer, the term of this patent is extended or adjusted under 35 U.S.C. 154(b) by 0 days.

(21) Appl. No.: 09/429,594

(22) Filed: Oct. 28, 1999

Related U.S. Application Data

(63) Continuation-in-part of application No. 09/033,476, filed on Mar. 2, 1998, now abandoned.

(51) Int. Cl.[7] ..... C25D 3/20; C25D 5/44; C25D 21/18; C25D 21/10; C23C 16/00

(52) U.S. Cl. ..... 205/270; 205/213; 205/99; 205/101; 205/148; 106/1.11; 106/1.27

(58) Field of Search ..... 205/213, 270, 205/99, 101, 148; 106/1.11, 1.27

(56) References Cited

U.S. PATENT DOCUMENTS

| | | | | |
|---|---|---|---|---|
| 1,729,607 | | 10/1929 | Bezzenberger | 205/148 |
| 1,791,642 | | 2/1931 | Schulte | 205/213 |
| 2,418,970 | | 4/1947 | Donroe | 204/43 |
| 3,597,267 | | 8/1971 | Mallory et al. | 117/130 |
| 3,627,545 | | 12/1971 | Mallory et al. | 106/1 |
| 3,806,139 | | 4/1974 | Suzuki et al. | 277/235 |
| 3,896,009 | | 7/1975 | Kobayashi et al. | 204/26 |
| 4,166,776 | | 9/1979 | Lefebvre et al. | 204/25 |
| 4,221,639 | | 9/1980 | Ninagawa | 204/26 |
| 4,746,412 | | 5/1988 | Uchida et al. | 204/44.7 |
| 4,800,132 | | 1/1989 | Grunwald et al. | 428/560 |
| 4,950,504 | | 8/1990 | Grunwald et al. | 427/242 |
| 5,132,003 | | 7/1992 | Mitani | 205/173 |
| 5,167,791 | | 12/1992 | Herbert et al. | 205/67 |
| 5,178,746 | * | 1/1993 | Darnall et al. | 205/287 |
| 5,368,719 | | 11/1994 | Troup-Packman | 205/213 |
| 5,472,788 | | 12/1995 | Benitez-Garriga | 428/472.2 |
| 5,516,419 | * | 5/1996 | Phan et al. | 205/148 |
| 5,772,865 | * | 6/1998 | Tanaka et al. | 205/261 |

FOREIGN PATENT DOCUMENTS

| | | | |
|---|---|---|---|
| 0500 15 A1 | | 8/1992 | (EP) . |
| 0118100 A2 | | 7/1989 | (JP) . |
| 1-181000 | * | 7/1989 | (JP) . |
| 10140388 | | 5/1998 | (JP) . |

OTHER PUBLICATIONS

Allied–Kellite Technical Data Sheet Barrett SIR—Ferrous Sulfamate Concentrate for Iron Plating Solutions (4 pgs.—R010975). No date available.

MacDermid Incorporated Barrett SIR—Ferrous Sulfamate Concentrate for Iron Plating Solutions Product Code No. 13421 (8 pgs.). No date available.

Metal Finishing—Guidebook and Directory Issued 1989 Iron Plating by Roland H. Williams (pps. 240–243).

"Effects of Hydroxycarboxylic acids on the electrodeposition of iron–carbon alloys" by Fukuwara, Yutaka et la. XP002110614, Chemical Abstracts, vol. 119, No. 18, Nov. 1, 1993 (1993–11–01).

Derwent abstract and chemical abstract.*

Allied–Kelite Technical Data Sheet, "Barrett SIR—Ferrous Sulfamate Concentrate for Iron Plating Solutions", pp. 1–4.*

* cited by examiner

*Primary Examiner*—Edna Wong
(74) *Attorney, Agent, or Firm*—Michael Best & Friedrich, LLP

(57) ABSTRACT

An electroplating formulation and process is provided for electroplating an iron layer onto an aluminum or aluminum alloy substrate. The method entails immersing an iron-containing anode and an aluminum containing cathode in an electroplating bath including boric acid in a concentration of at least about 50 grams per liter, and ferrous ions, and then applying electrical current to the cathode. A preferred electroplating bath solution includes the following: (1) $Fe^{+2}$ having a concentration ranging from about 0.65 to about 2.5 moles per liter of solution; (2) at least one anion associated with the $Fe^{+2}$ ion; (3) a reducing agent in an amount sufficient to prevent oxidation of $Fe^{+2}$ to $Fe^{+3}$; (4) $Cl^-$ in an amount sufficient to promote dissolution of the anode and increase the conductivity of the solution; (5) a wetting agent in an amount sufficient to prevent pitting of the aluminum electroplated surface; and (6) boric acid in a concentration of at least about 50 grams per liter.

35 Claims, No Drawings

ELECTROPLATING FORMULATION AND PROCESS FOR PLATING IRON ONTO ALUMINUM/ALUMINUM ALLOYS

CROSS-REFERENCE TO RELATED APPLICATION

The present application is a continuation-in-part of application Ser. No. 09/033,476, filed Mar. 2, 1998 now abandoned.

FIELD OF THE INVENTION

The present invention relates to the plating of aluminum and aluminum alloy substrates, and more particularly to the plating of aluminum and aluminum alloy substrates with iron.

BACKGROUND OF THE INVENTION

It is generally known to use aluminum or aluminum alloy substrates as structural members for many applications. The use of aluminum in many applications provides numerous advantages, because it is lightweight, easily handled, and generally inexpensive.

In various applications, however, it is desirable to coat the aluminum or aluminum alloy substrate with a dissimilar metal that is harder than aluminum. For example, it is known to use an aluminum or aluminum alloy substrate to make internal combustion engines with aluminum pistons wherein the aluminum piston or the cylinder bore is coated with another metal that is harder than aluminum to prevent piston skirt scuffing, galling and subsequent engine seizure.

One method for depositing iron coatings onto aluminum or aluminum alloy substrates is by electroplating. One such method for electroplating iron onto substrates containing aluminum is disclosed by U.S. Pat. No. 5,516,419 issued to Phan et al. (hereinafter "Phan"). In the process disclosed by Phan, a bath separate from the electroplating bath is required to activate the aluminum or aluminum alloy substrate. See Phan, Column 2, Lines 48–58. Additionally, after the substrate is activated, another separate bath is required to place a transitory protective layer, such as a zinc layer, onto the activated substrate to prevent aluminum oxides from reforming after the substrate has been activated. See Phan, Column 2, Lines 59–67, and Column 3, Lines 1–2. Finally, in Phan, an undercoating or intermediate layer, such as a nickel layer, is plated onto the substrate prior to plating iron onto the intermediate layer in another separate plating bath. See Phan, Column 3, Lines 3–25. The undercoating layer is required to provide a layer to which the subsequently-plated iron layer will adhere. See Phan, Column 3, Lines 16–22. In essence, the iron is not directly plated to the aluminum or aluminum alloy substrate, but is instead plated to an undercoating layer of a different metal which has in turn been plated onto the aluminum or aluminum alloy substrate.

The use of a method for electroplating as described in Phan has significant shortcomings for high volume commercial production. The use of a separate activation bath, a transitory layer, and a undercoating layer all add to the expense, complexity, and time involved with plating an iron layer onto an aluminum or aluminum alloy substrate. Additionally, the use of these separate steps and separate baths adds the difficulty and expense of disposing of the waste produced in each of these steps and baths.

Another problem that has existed with iron plating baths is that after use, impurities, such as copper or aluminum, remain in the bath solution and adversely affect further plating processes. When impurity concentration becomes too high, the iron plating process must be stopped so that the bath solution can be cleaned or changed.

An electroplating bath and electroplating method which permitted higher throughput before requiring bath cleaning would be highly desirable. In addition, the electroplated product should have good hardness or wear resistance properties.

It is desirable to provide a formulation and method for electroplating iron directly onto an aluminum or aluminum alloy substrate without the need of a separate activation bath, a transitory layer, or an undercoating layer.

It is also desirable to provide for a method and apparatus for purifying an iron plating bath solution to remove impurities from the bath without stopping the plating process to clean or change the bath solution.

SUMMARY OF THE INVENTION

The present invention is directed to an electroplating bath and a method of electroplating which provides high throughput for high volume commercial production. The resulting electroplated layer also has good hardness properties. Thus, larger volumes of product having greater hardness may be produced using the present invention.

One aspect of the present invention is a method for electroplating an iron layer onto an aluminum or aluminum alloy surface of a cathode from an iron-containing anode, the method comprising immersing the iron-containing anode and the cathode in an electroplating bath, which includes boric acid in a concentration of at least about 50 grams per liter (g/L), and applying electrical current to the cathode to electroplate an iron layer onto the cathode.

Another aspect of the invention includes a method for electroplating an iron layer onto an aluminum or aluminum alloy surface of an aluminum or aluminum alloy substrate cathode. The method includes providing an activation/electroplating bath solution including the following: (1) $Fe^{+2}$ having a concentration ranging from about 0.65 to about 2.5 moles per liter of solution; (2) at least one anion associated with the $Fe^{+2}$ ion; (3) a reducing agent in an amount sufficient to prevent oxidation of $Fe^{+2}$ to $Fe^{+3}$; (4) $Cl^-$ in an amount sufficient to promote dissolution of the anode and increase the conductivity of the solution; (5) a wetting agent in an amount sufficient to prevent pitting of the aluminum electroplated surface; and (6) boric acid in a concentration of about 50 to about 90 grams per liter of solution. The surface of the cathode is activated by immersing the cathode in the solution. The anode is also immersed in the solution. The iron layer is electroplated onto the activated aluminum or aluminum alloy surface of the cathode in the solution.

Another aspect of the invention includes the electroplating bath solution as disclosed above. In addition to the high throughput mentioned above, one feature and advantage of the current invention is to provide an iron coating on an aluminum substrate with the thickness of about 0.25 to about 0.6 mils and a micro-hardness up to about 60 Rockwell C that has exceptional adhesion and wear resistance characteristics.

Another feature and advantage of the current invention is to provide an iron plating formulation and method wherein the iron plating solution acts as both the chemical activation solution for the aluminum or aluminum alloy substrate and acts as the electroplating bath for depositing a hard iron layer directly onto the aluminum or aluminum alloy substrate.

Another feature and advantage of the current invention is to provide for plating iron directly onto an aluminum or aluminum alloy substrate without the need of a transitory layer to prevent oxidation of the activated surface of the substrate after activation.

Another feature and advantage of the current invention is to plate iron directly onto an aluminum or aluminum alloy substrate without the need of an undercoating.

Another feature and advantage of the current invention is to provide an iron coating on an aluminum substrate with the thickness of about 0.25 to about 0.6 mils and a microhardness up to about 60 Rockwell C that has exceptional adhesion and wear resistance characteristics.

Another feature and advantage of the present invention includes providing for removal of impurities that are dissolved in the electroplating bath on a continuous basis without the need to interrupt the electroplating process.

Other features and advantages of the invention will become apparent to those skilled in the art upon review of the following detailed description and claims.

Before embodiments in the invention are explained in detail, it is to be understood that the invention is not limited in its application for the details of the composition or concentrations of components set forth in the following description. The invention is capable of other embodiments and of being practiced or being carried out in various ways. Also, it is understood that the phraseology and terminology used herein are for the purpose of description and should not be regarded as limiting.

DETAILED DESCRIPTION OF PREFERRED EMBODIMENTS

The present invention provides an electroplating formulation and process which employs a mixed iron plating bath used to both chemically activate and to electrodeposit a hard iron layer on an aluminum or an aluminum alloy substrate. The bath contains ferrous ions and a relatively high concentration of boric acid.

As used herein, the term 'substrate' means any member or component made of or comprising aluminum or aluminum alloy to which the iron layer will be deposited using the formulation and process of the current invention. Preferably, the substrate is a piston made of aluminum or aluminum alloy that is for use in an internal combustion engine, but other aluminum or aluminum alloy parts, components, or members may be used as the substrate.

In preparing the substrate for iron plating, the substrate is first cleaned using a non-etching cleaning step. This cleaning step removes particulates, oil, grease, or other matter that may be present on the surface of the substrate as a result of previous machining operations or other handling. Many non-etching methods and compositions generally known may be used in this cleaning step.

Preferably, the cleaning step involves immersion of the substrate into a cleaning bath solution for a sufficient amount of time for the cleaning solution to remove particulate, oil, grease, or other matter from the substrate. Additionally, the cleaning bath solution is preferably maintained at a temperature of about 140° F. (60° C.), and the substrate is immersed in the cleaning solution for a sufficient amount of time to allow the part to reach the temperature of the cleaning solution, although this is not critical. Generally, times for immersion of the substrate in the cleaning solution range from about 15 seconds to about 2 minutes. However, immersion times outside of this range are workable.

Numerous commercially available cleaning solution products are readily available for use in the cleaning step. Preferably, the cleaning solution is an alkaline cleaning solution. One suitable cleaning solution is commercially available from Deveco Corporation under the trademark DEVECO 232.

After being cleaned in the cleaning step, the substrate is then rinsed in water to remove excess cleaner.

The substrate is then etched in an etching step. The etching step removes excess silicon that may be present on the surface of the substrate, and provides a mechanical tooth on the surface of the substrate that allows for an increased adhesion between the surface of the substrate and the iron coating, as will be seen below.

Those skilled in the art will recognize that there are many methods and formulations that may be used to etch the substrate. Preferably, the etching step of the current invention involves immersion of the substrate into an etch bath comprising a suitable etching solution.

Typical etching solutions include various combinations of sulfuric, hydrochloric, and hydrofluoric acid. Any of the acid etches known to those skilled in the art for removing excess silicon, removing aluminum oxides and providing for a mechanical tooth on the surface of the substrate may be employed as the etching solution. Preferably, an acid containing fluorine is used for the effective removal of excess silicon. One known acid etch which is suitable for use as the etching solution in the current invention comprises about 50% nitric acid, about 10% hydrofluoric acid, and the remainder being water.

Generally, the substrate is immersed in the etch bath for an amount of time sufficient to provide for the desired etching results. Preferably, the substrate is immersed in the etch bath for about 10 to about 50 seconds, and more preferable for about 20 to about 40 seconds. After removing the substrate from the etched bath, it is rinsed with water to remove any excess etching solution.

The etching step does remove the aluminum oxides from the surface of the substrate, thereby chemically activating the surface of the substrate. It is at this point where previous formulations and methods, such as the process described in the Phan patent, deposit a transitory protective layer to the surface of the substrate to preserve the activation. For example, in the Phan process, a zinc layer was deposited. Additionally, previous formulations and methods, such as that disclosed in Phan, would then plate an intermediate metal layer, such as nickel, to the surface of the substrate, and then plate iron over the intermediate layer.

In the current invention, neither the protective transitory layer nor the undercoating layer is needed or used. After the activation step, the substrate is rinsed with water. It is likely that an aluminum oxide layer again forms on the surface of the substrate, thereby deactivating the surface. The activation provided by the etching step need not be maintained in the current invention because, as will be seen below, the electroplating solution can act as both an activating solution and the electroplating solution.

Once the substrate has been prepared for plating as described above, the substrate is ready for activation and plating. In the activation/electroplating process, the substrate is immersed in an activation/electroplating bath. The electroplating bath includes boric acid in a concentration of at least about 50 grams per liter (g/L) (6.7 ounces/gallon) of electroplating bath solution. (1 ounce/gallon=7.5 grams/liter). The boric acid acts to increase hardness of the electroplated, new layer, and to prevent or minimize iron oxide formation as aluminum concentration increases in the bath. The aluminum appears to act as a catalyst with the iron in forming iron oxides, which can lead to defective plating. Thus, the boric acid inexplicably provides greater tolerance for aluminum poisons in the bath.

Therefore, the relatively high boric acid concentration surprisingly increases throughout because the bath requires cleaning less frequently which results in less down time.

In order to obtain the benefits of high throughput and hardness, the concentration of boric acid in the solution is preferably greater than about 50 grams per liter (g/L) of solution; more preferably, about 60 g/L. In order to maintain a usable bath solution, the concentration of boric acid is preferably less than the solubility limit of boric acid in the bath solution; more preferably, less than about 90 g/L; more preferably, less than about 80 g/L; and most preferably, less than about 65 g/L. Boric acid concentration may be measured, for example, using customary titration techniques.

Boric acid is consumed during the electroplating process. Therefore, in order to maintain the boric acid concentration within the desired range, additional boric acid should be added to the bath over time. It is not necessary to add boric acid continuously, however. The boric acid may be added to a portion of the electroplating solution outside the main tank and then bled slowly into the tank, for example, through a recirculating filter system.

The bath preferably includes an aqueous, or a water-based, activation/electroplating solution of ferrous ions and other necessary components.

The activation/electroplating bath preferably includes the following components:

(1) $Fe^{+2}$ having a concentration ranging from about 0.65 to about 2.5 moles per liter of solution;

(2) at least one anion associated with the $Fe^{+2}$ ion;

(3) a reducing agent in an amount sufficient to prevent oxidation of $Fe^{+2}$ to $Fe^{+3}$;

(4) $Cl^-$ in an amount sufficient to promote dissolution of the anode and increase the conductivity of the solution;

(5) a wetting agent in an amount sufficient to prevent pitting of the aluminum electroplated surface by preventing adherence of hydrogen gas bubbles to the substrate surface; and (6) boric acid in a concentration of from about 50 to about 90 g/L of electroplating bath.

The composition of the activation/electroplating bath solution is preferably a mixed iron sulfamate/iron chloride bath. The bath preferably includes a total $Fe^{+2}$ content of about 0.65 to about 2.5 moles per liter of solution. More preferably, the total $Fe^{+2}$ content of the electroplating bath is from about 1.0 to about 2.15, and most preferably is about 1.8 moles per liter of solution.

The anion associated with the $Fe^{+2}$ ion can be generally selected from the group consisting of sulfamate, ammonium sulfate, and chloride. Preferably, the anion associated with the $Fe^{+2}$ ion is sulfamate, because it is believed that the sulfamic acid that is formed in the bath due to the presence of the sulfamate ion performs, at least partially, the activation function as will be seen below.

One suitable source for iron and ferrous sulfamate is a product called BARRETT SIR ferrous sulfamate concentrate which is commercially available from MacDermid, Incorporated.

The bath also includes a reducing agent to maintain iron in the ferrous state. The reducing agent is needed in an amount sufficient to prevent the oxidation of $Fe^{+2}$ to $Fe^{+3}$. Suitable reducing agents include those known in the art which do not have a significant detrimental effect upon the activation/electroplating function of the bath. Preferably, the reducing agent is selected from the group consisting of glycolic acid, ascorbic acid, sodium bisulfite, sodium metabisulfite, sodium hydrosulfite, sodium hypophosphite, hydrazine, boric acid, and mixtures thereof. More preferably, the reducing agent includes glycolic acid, and is employed in a concentration ranging from about 0.01 to about 0.10, more preferably about 0.03 to about 0.05, and most preferably about 0.04 percent by volume of the total solution. One suitable reducing agent is commercially available from MacDermid Incorporated under the name SISR. It is thought that SISR includes from about 0.5 to about 1% glycolic acid, from about 0.1 to about 1% carbon, with the remainder being water.

$Cl^-$ must also be present in the bath. The $Cl^-$ anion serves three important functions in the bath. First, $Cl^-$ helps to promote the dissolution of the anode. Second, the $Cl^-$ provides for increased conductivity within the bath, thereby increasing the efficiency of the electroplating process. Finally, the $Cl^-$ helps in the formation of the iron crystalline structure such that the iron is in a martensitic form.

The source for the $Cl^-$ is generally a chloride salt that is added to the bath. Preferably, the source of $Cl^-$ is selected from the group consisting of sodium chloride, potassium chloride, ammonium chloride, calcium chloride, and mixtures thereof. More preferably, the source of Cl– is pure sodium chloride.

The concentration of Cl– in the bath can range from about 0.17 to about 1.02 moles per liter of solution, and may be between about 0.17 and about 0.34 moles per liter of solution. Preferably the concentration of Cl– ranges from about 0.34 to about 1.00, and most preferably is about 0.68 moles per liter.

A wetting agent is employed in the activation/ electroplating bath solution in an amount sufficient to prevent pitting of the electroplating surface by attachment of hydrogen bubbles during electroplating. This is necessary since hydrogen evolution occurs during the iron deposition on the aluminum cathodes. The wetting agent prevents adherence of hydrogen bubbles on the aluminum cathode that would otherwise cause pitting of the aluminum part or cracking of the iron deposit due to embrittlement.

Most known wetting agents may be employed in the practice of the present invention. The wetting agent selected should not significantly interfere with the activation or electroplating function of the bath. Preferably, the wetting agent used is selected from the group consisting of sodium lauryl sulfate, polyethylene glycol, and mixtures thereof. Most preferably, the wetting agent used is sodium lauryl sulfate. A suitable wetting agent is commercially available from MacDermid Incorporated under the name SNAP-L.

The wetting agent generally makes up from about 0.1% to about 0.3% of the total bath by volume. Preferably, the wetting agent makes up about 0.2% of the total bath by volume.

Additionally, ammonium ion may also be employed in the bath. The ammonium ion is thought to contribute to the hardness of the electroplate without sacrificing ductility. It is believed that the additional ammonium ion acts as a grain refiner and thereby helps to form the crystalline structure of the iron coating.

The source of the ammonium ion may be any known source of ammonium that will not have a significant detrimental impact upon the function of the bath. Preferably, the source of ammonium is selected from the group consisting of ammonium sulfamate, ammonium hydroxide, and mixtures thereof. Most preferably, the source of ammonium is ammonium sulfamate.

The ammonium concentration in the bath is in the range of about 0.08 to about 0.55 moles per liter. Preferably, the ammonium concentration is from about 0.17 to about 0.40, and most preferably about 0.30 moles per liter.

The iron plating bath may also include appropriate additional agents, such as wetters, brighteners, and stress reducing agents, and other appropriate agents commonly employed in iron plating, to enhance the plating characteristics. A brightener permits the use of higher current densities, which make it possible to plate the part faster. The composition and concentration of such addition agents are well known in the art.

The activating/plating bath of the invention is maintained at a pH of about 1 to about 4, more preferably from about 1.5 to about 3.5, and most preferably at a pH of about 2.75. The pH of the plating solution appreciably influences the structure and mechanical properties of the iron deposit. Accordingly, this pH range provides the best combination of desired structural and mechanical properties of the iron deposit. The pH is adjusted with one of sulfamic acid, sulfuric acid, or ammonium hydroxide, or combinations thereof, as appropriate. As the plating process proceeds, and the bath is operating properly, the pH tends to rise slowly. It is preferable to adjust the rising pH by adding sulfamic acid to the bath to maintain the iron sulfamate characteristics, and maintain the activation characteristics of the bath. On a short term basis, other acids may be used to adjust the pH downwardly, but the use of sulfamic acid is preferred to maintain these preferred characteristics of the bath.

The activating/plating bath is maintained at a normal bath operating temperature that ranges from about 80° F. to about 170° F. Preferably, the operating temperatures are about 120° F. to about 140° F., and most preferably about 130° F. The temperature affects the deposition rates and the internal stresses of the iron deposits. Accordingly, the preferred plating temperature ranges provide the best combination of desired deposit rate and reduced internal stresses of the iron deposit.

The substrate is immersed in the plating bath and the plating bath acts to remove the aluminum oxide from the surface of the substrate and thereby activate the substrate. The substrate therefore has a surface which is aluminum or aluminum alloy. It is believed that the sulfamic acid that is formed in the bath due to the presence of the sulfamate ion performs, at least partially, the activation function.

The substrate is then electroplated in the same tank and with the same electroplating solution as the activation immediately following activation and directly over the activated substrate. During electroplating, the substrate is made the cathode, and an appropriate iron containing anode is used to complete the circuit.

In the current invention, any suitable iron containing anode can be employed. Pure iron, and carbon steel cathodes are preferably used. Most preferably, due to cost and availability, the cathode used in the current invention is a carbon steel cathode.

The iron electroplating bath is agitated, for example, by stirring, by mechanical agitation, by bubbling inert gas such as nitrogen through the bath, by plating parts rotating in the bath, or by ultrasonic agitation. However, agitation using air should be avoided, since this results in excessive oxidation of the Fe(II). A higher level of mixing may provide fewer defective products. A mixing rate of greater than about 10 bath turnovers/hour, and preferably greater than about 15 bath turnovers/hour is preferred.

A current having a current density between about 10 to about 120 amps per square foot is applied on the substrate, as cathode. Preferably, the current density is between about 20 and about 100, and most preferably is about 80 amps per square foot. The preferred ranges of current density provide the best combination of fast plating time consistent with good visual appearance of the iron plate.

The iron is plated directly onto the aluminum or aluminum alloy substrate to a thickness of about 0.0002 to about 0.002 inch. Preferably, the thickness is between about 0.000250 to about 0.000600, and more preferably, between about 0.00035 to about 0.0004 inch in thickness so as to achieve high hardness without increasing internal stresses.

The dwell time needed to obtain the desired thickness is inversely proportional to the current density used. The dwell time can range from about 4 minutes to about 30 minutes depending upon the current density used and the desired thickness. For example, if a thickness of 0.00035 inches is desired, and a current density of about 100 amps per square foot is used, a dwell time of about 4 minutes is needed. Likewise, if a thickness of 0.00035 inches is desired, and a current density of about 20 amps per square foot is used, a dwell time of about 30 minutes is needed. Preferably, the dwell time is about 6 minutes and 45 seconds at a current density of about 80 amps per square foot. However, shorter or longer times at higher or lower current densities, respectively, may be employed in the practice of the invention to obtain the desired thicknesses. It is important to note that faster rates of iron deposition result in higher hardness of the electroplate. This increased hardness is important for substrates such as pistons used in the lawn and garden industry, where engines typically operate at high grit conditions in which the piston is subject to considerably more abrasion than would be found in most automotive applications.

The use of this activation/electroplating formulation and process allows the formation of relatively thick iron layers from about 0.25 to about 0.6 mils that have a micro-hardness greater than about 50 Rockwell C. Preferably, the micro-hardness is greater than about 55 Rockwell C; more preferably, greater than about 60 Rockwell C.

After electroplating, the part is removed from the activation/electroplating bath and rinsed with cold water to remove excess plating solution.

The rinse may then be followed by a step wherein a rust inhibiting or protective agent is applied to the iron coated substrate. Conventionally known agents and methods for inhibiting rust and protecting the iron may be used in the current invention.

Preferably, the rust inhibiting application step includes immersion of the iron coated substrate in a rust inhibitor solution containing rust inhibiting agents immediately after rinsing. The rust inhibitor solution may contain sodium metasilicate, ethanolamine, alcohols, and a surfactant to prevent flash rusting of the active iron deposited on the substrate. One suitable rust inhibiting solution comprises about 97% water and 3% neutralizing rinse mixture, wherein a suitable neutralizing rinse mixture is commercially available from Broco Products Incorporate of Cleveland, Ohio under the trademark V200NC. The preferred neutralizing rinse mixture provides a completely dry to the touch substrate in addition to the rust protection without the use of another flash plating procedure.

Alternatively, oil-based rust inhibitors may be employed. Longer term rust protection means such as soluble oils, mineral oils, greases, etc. can be utilized as off line procedures after the iron plated substrate has been removed from the vicinity of the electroplating bath and apparatus. When using oil-based rust inhibitors, care should be taken to minimize the amount of oil which may be inadvertently placed into the electroplating bath. Such oils in an electroplating bath may cause operating problems and electroplating defects. One suitable oil-based rust inhibitor contains petroleum wax and is available from Castrol as 4135HF. Oil carryover into other baths may be minimized, for example, by increasing the concentration of cleaner in the initial cleaning bath and by frequently changing the solution in the cleaning tank. This will help remove residual oil on the support structure used to support the substrate after a new substrate is placed on the support structure.

The apparatus usable to perform the current invention of electroplating iron directly onto the substrate using the above discussed formulations and process are apparatus that are generally well known in the art for use in electroplating.

Generally, the activation/electroplating bath is maintained in a tank that is made of or lined with a material that is resistant to all of the chemicals used in the bath. Preferably, the tank is lined with a material such as polyvinyl chloride or polypropylene. The tank must be large enough to accommodate the activation/electroplating bath solution, the substrate to be plated, the anode, and any type of support structure that may be used to support or hold the substrate in the bath. Preferably, the tank for use in the current invention is about 900 gallons.

A support structure such as a support rack or tree is preferably use to support the substrate throughout the activation/electrodeposition process. The shapes and sizes of such support racks/trees usable in the current invention are well known in the art. Preferably, the support racks/trees are shaped such that when they are supporting the substrates to be plated, the distance between the center of the substrate being plated and the center line of the anode is about 7 inches.

The support rack/tree may include current thieves attached thereto. Generally, the function and placement of current thieves are known in the art for use in other electroplating applications, but their use in the electrodeposition of iron, especially the electrodeposition of iron using the current formulation and method, are thought to be new. The form and function of current thieves as known in the art for use in other applications are generally suitable for use in the current invention.

The substrates to be plated with iron are generally placed upon the plating rack/tree. Without the current thieves, the substrates mounted on the ends of the rack/tree would generally receive higher current densities than the substrates near the middle of the rack/tree. As the electrodeposition proceeds, the substrates receiving the higher current densities receive a higher rate of iron deposition. Therefore, a thicker final coating of iron will be deposited on the substrates near the ends of the rack/tree in comparison to those in the middle of the rack/tree.

However, a uniform final coating thickness is usually desired among all of the substrates on a given rack/tree. Therefore, the current thieves are used and act to lessen the current densities in the substrates supported on the ends of the rack/tree, thereby substantially equalizing the amount of current running through all of the substrates mounted on a rack/tree. The substantial equalization of the current densities helps to provide a substantially uniform thickness of iron coating among all of the substrates on a single rack/tree. Preferably, the current thieves are steel plates mounted at the edges of the support rack/tree.

In the electroplating process, metal impurities may be deposited in the bath. Aluminum and copper from the substrate may be dissolved into the electroplating bath and become impurities within the bath. If the aluminum and/or copper impurity level becomes too high, defects begin to be created in the plating process.

Another aspect of the current invention, however, makes it possible to remove these metals impurities. In one embodiment of the invention, the copper and aluminum impurities are removed from the bath by a precipitation step. In the precipitation step, the pH of the bath is purposefully increased to about 5.5 at which point the aluminum and copper ions precipitate out of solution. Ammonium hydroxide is a suitable base. The solid aluminum and copper can then be removed from the bath, for example, by filtration.

Preferably, however, the aluminum and copper impurities are removed from the bath on a continuous basis by the use of an ion exchange apparatus and method. The ion exchange apparatus includes an ion exchange column that is in fluid communication with the tank containing the activation/electroplating bath. The ion exchange column has a first end and a second end. The first end of the column is interconnected with the tank such that the column is in fluid communication with the tank with a first pipe. The second end of the column is interconnected with the tank such that the column is in fluid communication with the tank with a second pipe. The ion exchange column includes an ion exchange resin contained therein. The ion exchange resin is of a type that will perform ion exchange with the copper and aluminum ions present within the activation/electroplating bath. One suitable ion exchange resin is available from Rohm and Hass Company under the trademark IRC-718.

As the activation/electroplating bath portion is filtered through the ion exchange column, ion exchange occurs to remove the aluminum and copper ions from the bath. The purified bath is then moved from the opposite end of the ion exchange column and returned to the activation/electroplating bath tank.

It is desirable, however, to use the ion exchange method of removing the aluminum of copper from the bath because it is a continuous process and activation/ electroplating of the aluminum or aluminum alloy parts does not need to be interrupted.

The following example is intended to exemplify one embodiment of the invention and is not to be construed as a limitation thereof.

EXAMPLE 1

In this example, aluminum alloy pistons for use in internal combustion engines were used as the substrate. A layer of iron was coated directly onto the aluminum alloy surface of the pistons using a method and activation/electroplating bath embodying the current invention.

First, the aluminum alloy pistons were mounted onto a workbar or rack and put through a cleaning step. In the cleaning step, the pistons were immersed in a non-etching alkaline cleaner, DEVECO 232 cleaning solution, at a 3% concentration at 140° F. for a period of 4 minutes to loosen and remove any soils, chips, soluble oils or coolants from previous machining operations. The pistons were then rinsed thoroughly with water in two air agitated counterflow rinses to remove any residual cleaner.

The pistons were then ready for chemical etching and milling of the surface to provide a mechanical "tooth" for the iron plating. The pistons were submerged in the nitric/hydrofluoric acid mixture for a period of 30 seconds to remove any silica that was present and to roughen the surface until a uniform gray-white matted surface was obtained. The acid utilized in the chemical etching was a mixture of seven volumes of 36° Baume' (52.3% nitric acid) and one volume of 70% hydrofluoric acid operating at room temperature.

After chemical etching, the pistons were rinsed twice with water in a counterflow rinsing operation before being placed into an activation/electroplating bath.

An activation/electroplating bath solution was prepared by incorporating BARRETT SIR ferrous sulfamate concentrate, BARRETT SISR stabilizer, SNAP-L wetting agent, each of which is commercially available from MacDermid, Incorporated, and ferrous iron, ammonium sulfamate, sodium chloride, and boric acid.

A suitable bath tank, anodes, and filtration equipment was cleaned and leached as known in the art. The required amount of water was added to the tank, and the pH of the water was reduced to about 2.5 by adding acid. The required quantity of BARRETT SIR ferrous sulfamate concentrate was diluted with water in the cleaned tank. The necessary amount of boric acid was added, and then necessary amount of BARRETT SISR stabilizer was added. The system was then heated to operating temperature, and the required amount of ammonium sulfamate and sodium chloride was added. Thereafter, SNAP-L wetting agent was added in the required amount, and the solution was brought to operating level with water. The pH was adjusted, as necessary, to about 2.5. The solution was then dummied at 0.2 to 0.5 with mild agitation for several hours while maintaining the pH between about 2.5 and about 3.0.

The activation/electroplating bath used in this example had an $Fe^{+2}$ concentration of 10 oz/gal and a pH of 2.75. Glycolic Acid, from the BARRETT SISR stabilizer, was used as a reducing agent at a concentration of 0.3% by volume. Sodium chloride was used as the source of $Cl^-$ and was added at a concentration of 5.5 oz/gal. Sodium lauryl sulfate, from the SNAP-L, was the wetting agent present in the bath in a concentration of about 0.2% by volume. Ammonia sulfamate was used as the source of ammonium, and was present in the solution in a concentration of 4.5 oz/gal. Boric acid was present in the solution at a concentration of 2.5 oz/gal.

The pistons were then placed into the plating bath. The surface of the aluminum alloy pistons was activated by the bath. Voltage was applied to the workbar and the pistons were plated at a cathode current density of 70 amps per square foot for a period of 6 minutes and 45 seconds at a temperature of 130° F. The pistons were plated with the aid of "current thieves" mounted on the work bar to maximize the uniformity of plating for all the pistons which ranges from 72 to 120 on the workbar.

During the plating process, the bath pH was maintained at about 2.75 while iron concentration in the bath was maintained at about 10 oz/gal. Sulfamic acid was used to maintain pH. The iron concentration was maintained by the anode.

The concentration of ammonia sulfamate was maintained at about 4.5 oz/gal and the concentration of sodium chloride was maintained at about 5.5 oz/gal. The concentration of the glycolic acid was maintained at about 0.3% by volume and the concentration of the boric acid was maintained at about 8 oz/gal (64 g/L).

The boric acid concentration was maintained within a range of 7 to 8.5 oz/gallon by adding boric acid incrementally as the boric acid was consumed by the reaction. Approximately ¼ to ½ ounce per gallon was added about every four hours until the bath was cleaned.

During electroplating, the bath was filtered continuously through 25 micron filters at a rate of about 15–20 bath turnovers per hour as well as the bath being cleaned of contaminants by an ion exchange process that removes the aluminum and copper dissolved in the bath during electroplating. The ion exchange process utilizes a selective ion exchange resin for removal of the aluminum and copper under the acidic conditions present in the bath. A 1–5% cross-linked strong acid resin is used alternately for removal of the aluminum only. In either case, the ion exchange resin is regenerated by acid stripping of the contaminants with hydrochloric acid followed by removal of ferric iron on the resin with a mixture of sodium bisulfite/sodium hydrosulfite followed by putting the resin back into the sodium form fully with sodium chloride. During extended periods of inactivity, the bath is cleaned by adjustment of the pH to 5.5 with ammonium hydroxide to precipitate the aluminum followed by dummying of the bath to remove the copper and other trace metals that may be present. Over 70,000 pistons were plated before the bath required cleaning.

After electroplating, the pistons were removed from the bath and quickly rinsed with water in a 3 stage counterflow rinse operation that removes the residual plating solution from the pistons. The pistons were then immersed in a commercially available neutralizing alkaline cleaner/rust preventer containing sodium metasilicate at 3% concentration at 160° F. for a period of 30 seconds. The pistons were removed from the bath and excess water is allowed to flash dry from the surface of the pistons before removing them from the workbar.

A number of the pistons that were electroplated in the above method were then subjected to various tests. One of these tests included a microhardness measurement perpendicular to the thickness of the electroplate. The microhardness of the iron plating measured between about 57 and 58 Rockwell C on average using a new bath. After the bath became seasoned in use and with periodic bath treatment by precipitation the average hardness was measured to be about 65 Rockwell C.

Adhesion tests were also conducted. One adhesion test consisted of slowly heating the electroplated piston to 600° F. followed by quick immersion into cold 50° F. water. The pistons subjected to this test illustrated no significant loss of adhesion of the iron layer on the aluminum alloy piston even when this test is repeated 20 times in succession on the same piston.

Another test included endurance testing whereby an electroplated piston was placed in an engine and the engine was operated at rated speed and full load for a period of 500 hours minimum. The plating on the pistons that were plated in the above process withstood the test, and did not wear through, and galling/seizing of the engine did not occur.

Cold box starting tests of an engine incorporating an iron-plated piston of the current invention were conducted at −20° F. Additionally, grit tests of an engine incorporating an iron-plated piston of the current invention were also conducted, whereby a measured amount of a particular fineness of grit is added to the engine oil before running at full load. The iron-plated pistons of the current invention did as well as or exceeded the performance of chrome plated pistons in these tests in side by side testing. Peak torque tests and duty cycle tests for various types of driven equipment were also conducted. Generator cycle testing, on-off cycle tests, oil consumption tests, piston scuff tests, and air emissions tests were also conducted to determine the overall effectiveness and viability of the electroplating. In each of these tests, the iron-plated pistons of the current invention exhibited good strength and wear resistance, and did as well as or exceeded the performance of chrome plated pistons.

Comparison

Aluminum pistons were plated as described in Example 1 above, except the concentration of boric acid was maintained at about 2 to 3 oz/gal, and the mixing rate was about 3 bath turnovers per hour. The Rockwell C hardness measured between about 50 and 57 Rockwell C, with most falling between about 52–54.

TABLE 1

| Boric Acid Concentration (ounces/gallon) | Bath Turnovers Per Hour | Throughput (number of pistons plated before bath treatment) | Average Hardness (Rockwell C) |
|---|---|---|---|
| 7–8.5 (52.5–63.75 g/L) | 15–20 | 70,000+ | 57–58 (new bath) ~65 (seasoned bath) |
| 2–3 (15–22.5 g/L) | ~3 | ~10,000 | 52–54 |

The results in Table 1 show a significant increase in hardness and a surprising increase in throughput using higher boric acid concentrations. An increase in hardness of even 2 on a Rockwell C hardness scale provides much greater resistance to engine wear.

Various feature and advantages of the invention are set forth in the following claims.

What is claimed is:

1. A method for electroplating an iron layer onto an aluminum or aluminum alloy surface of an aluminum or aluminum alloy substrate cathode from an iron containing anode, said method comprising:

providing an activation/electroplating bath solution comprising:

$Fe^{+2}$ having a concentration ranging from about 0.65 to about 2.5 moles per liter of solution;

at least one anion associated with the $Fe^{+2}$ ion;

a reducing agent in an amount sufficient to prevent oxidation of $Fe^{+2}$ to $Fe^{+3}$;

$Cl^-$ in an amount sufficient to promote dissolution of the anode and increase the conductivity of the solution;

a wetting agent in an amount sufficient to prevent pitting of an aluminum electroplated surface; and boric acid in a concentration of at least about 50 grams per liter of solution;

activating said surface of said cathode by immersing said cathode in said solution; immersing the anode in said solution; and electroplating said iron layer directly onto said activated aluminum or aluminum alloy surface of said cathode in said solution from said iron containing anode, wherein the method is carried out without the use of an undercoating layer.

2. The method of claim 1 wherein said electroplating step includes electroplating at a current density ranging from about 10 to about 120 Amp/ft$^2$ for a dwell time sufficient to plate said layer of iron onto said surface to a thickness ranging from about 0.0002 to about 0.002 inch.

3. The method of claim 1 wherein said electroplating step includes electroplating such that said iron layer has a microhardness of at least about 50 Rockwell C.

4. The method of claim 1 wherein said electroplating step includes electroplating such that said iron layer has a microhardness of at least about 55 Rockwell C.

5. The method of claim 1 wherein said providing step further includes providing said bath solution with ammonium ion in an amount sufficient to contribute to the hardness of said iron layer.

6. The method of claim 5 wherein the ammonium ion is provided in a concentration between about 0.08 and about 0.55 moles per liter.

7. The method of claim 5 wherein the ammonium ion is provided by a compound selected from the group consisting of ammonium sulfamate, ammonium hydroxide, and mixtures thereof.

8. The method of claim 1 wherein said providing step further includes providing said anion associated with the $Fe^{+2}$ ion that is selected from the group consisting of sulfamate, ammonium sulfate, and chloride.

9. The method of claim 1 further including the step of maintaining the pH of said solution between about 1 and about 4 during the electroplating step.

10. The method of claim 1 further including a step of continuously removing impurities from said solution during the electroplating step by utilizing an ion exchange column in fluid communication with said solution.

11. The method of claim 10 wherein the step of continuously removing impurities includes providing the ion exchange column with a selective ion exchange resin for removal of aluminum and copper.

12. The method of claim 11 further including, after said electroplating step, the step of regenerating said ion exchange resin by acid stripping.

13. The method of claim 1 further including, after said electroplating step, the step of precipitating impurities from the solution by increasing the pH of the solution.

14. The method of claim 1 wherein said immersing step further includes providing said anode made of carbon steel.

15. An electroplating bath solution for use in electroplating an iron layer onto an aluminum or aluminum alloy surface of a cathode, the bath solution comprising:

$Fe^{+2}$ having a concentration ranging from about 0.65 to about 2.5 moles per liter of solution;

at least one anion associated with the $Fe^{+2}$ ion;

a reducing agent in an amount sufficient to prevent oxidation of $Fe^{+2}$ to $Fe^{+3}$;

$Cl^-$ in an amount sufficient to promote dissolution of an anode and increase the conductivity of the solution;

a wetting agent in an amount sufficient to prevent pitting of the cathode surface; and boric acid in a concentration of from about 50 to about 90 grams per liter of solution.

16. The electroplating bath solution of claim 15 wherein at least one anion associated with the $Fe^{+2}$ ion is sulfamate.

17. The electroplating bath solution of claim 15 wherein the reducing agent is selected from the group consisting of glycolic acid, ascorbic acid, sodium bisulfite, sodium metabisulfite, sodium hydrosulfite, sodium hypophosphite, hydrazine, boric acid, and mixtures thereof.

18. The electroplating bath solution of claim 15 wherein the reducing agent includes glycolic acid having a concentration ranging from about 0.01 to about 0.10 percent by volume of said solution.

19. The electroplating bath solution of claim 15 wherein said $Cl^-$ has a concentration between about 0.165 and about 1.00 moles per liter.

20. The electroplating bath solution of claim 15 wherein the wetting agent is selected from the group consisting of sodium lauryl sulfate, polyethylene glycol, and mixtures thereof, and wherein said wetting agent is present in an amount ranging from about 0.1 to about 0.3 percent by volume of the solution.

21. The electroplating bath solution of claim 15 wherein the concentration of said boric acid is less than about 65 grams per liter.

22. The electroplating bath solution of claim 15 further comprising ammonium ion in a concentration of between about 0.08 and about 0.55 moles per liter of solution.

23. The electroplating bath solution of claim 22 wherein the ammonium ion in said solution is provided by a compound selected from the group consisting of ammonium sulfamate, ammonium hydroxide, and mixtures thereof.

24. The electroplating bath solution of claim 15 wherein said iron layer has a microhardness of at least about 55 Rockwell C.

25. The electroplating bath solution of claim 15 wherein the pH of the solution is between about 1 and about 4.

26. A method for electroplating an iron layer onto an aluminum or aluminum alloy surface of a cathode from an iron-containing anode, the method comprising immersing the iron-containing anode and the cathode in an electroplating bath, the electroplating bath includes boric acid in a concentration of at least about 50 grams/liter, and applying electrical current to the cathode to electroplate the iron layer onto the cathode.

27. The method of claim 26 wherein the electroplating bath includes boric acid in a concentration less than the saturation level of boric acid in the bath.

28. The method of claim 26 wherein the electroplating bath further comprises:

$Fe^{+2}$ having a concentration ranging from about 0.65 to about 2.5 moles per liter of solution;

at least one anion associated with the $Fe^{+2}$ ion;

a reducing agent in an amount sufficient to prevent oxidation of $Fe^{+2}$ to $Fe^{+3}$;

$Cl^-$ in an amount sufficient to promote dissolution of the anode and increase the conductivity of the solution; and a wetting agent in an amount sufficient to prevent pitting of an aluminum electroplated surface.

29. The method of claim 26 wherein the electroplating bath is mixed at a rate of at least about 10 bath turnovers per hour.

30. The method of claim 26 wherein the electroplating bath further includes iron sulfamate and iron chloride.

31. A method for electroplating an iron layer onto an aluminum or aluminum alloy surface of an aluminum or aluminum alloy substrate cathode, said method comprising:

providing an activation/electroplating bath solution comprising:

(1) $Fe^{+2}$ having a concentration ranging from about 0.65 to about 2.5 moles per liter of solution;

(2) at least one anion associated with the $Fe^{+2}$ ion;

(3) a reducing agent in an amount sufficient to prevent oxidation of $Fe^{+2}$ to $Fe^{+3}$ ;

(4) $Cl^-$ in an amount sufficient to promote dissolution of an anode and increase the conductivity of the solution; and (5) a wetting agent in an amount sufficient to prevent pitting of an aluminum electroplated surface;

activating said surface of said cathode by immersing said cathode in said solution;

immersing the anode in said solution;

electroplating said iron layer directly onto said activated aluminum or aluminum alloy surface of said cathode in said solution; and removing impurities from said solution.

32. The method of claim 31 wherein the impurities are removed by precipitation with a base.

33. The method of claim 31 wherein the impurities are removed from the solution during the electroplating step by utilizing an ion exchange column.

34. A method of improving throughput of an electroplating bath solution for use in electroplating an iron layer onto an aluminum or aluminum alloy surface of a cathode, the method comprising:

providing an electroplating bath solution comprising:

$Fe^{+2}$ having a concentration ranging from about 0.65 to about 2.5 moles per liter of solution;

at least one anion associated with the $Fe^{+2}$ ion;

a reducing agent in an amount sufficient to prevent oxidation of $Fe^{+2}$ to $Fe^{+3}$;

$Cl^-$ in an amount sufficient to promote dissolution of the anode and increase the conductivity of the solution; and a wetting agent in an amount sufficient to prevent pitting of an aluminum electroplated surface; and adding boric acid in a concentration of at least about 50 grams per liter of solution, the concentration of boric acid increasing throughput of the electroplating bath.

35. The method of claim 34, wherein the electroplating bath improves hardness of the iron layer coated onto the aluminum or aluminum alloy surface.

* * * * *